United States Patent [19]

Tholomé

[11] 4,335,342

[45] Jun. 15, 1982

[54] RECIPROCATING DRIVE SYSTEM FOR A BODY SUCH AS A CARRIAGE SUPPORTING ELECTROSTATIC MEANS FOR SPRAYING A PULVERIZED MATERIAL, THE SYSTEM INCLUDING AN ASYNCHRONOUS SQUIRREL CAGE MOTOR

[75] Inventor: Roger Tholomé, La Tronche, France

[73] Assignee: Air Industrie, Societe Anonyme, Courbevoie, France

[21] Appl. No.: 105,526

[22] Filed: Dec. 20, 1979

[30] Foreign Application Priority Data

Dec. 22, 1978 [FR] France ..... 78 36615

[51] Int. Cl.[3] ..... G05G 5/00

[52] U.S. Cl. ..... 318/627; 318/743; 318/739; 318/755; 318/758; 318/759; 318/807; 318/282; 318/783; 318/784; 318/778

[58] Field of Search ..... 318/627, 739, 740, 741, 318/743, 755, 757, 758, 759, 778, 783, 784, 807, 281, 282

[56] References Cited

U.S. PATENT DOCUMENTS

| | | | |
|---|---|---|---|
| 3,989,993 | 11/1976 | Ewing | 318/282 |
| 4,072,880 | 2/1978 | Oshima et al. | 318/778 |
| 4,078,198 | 3/1978 | Murakosi et al. | 318/627 |
| 4,084,202 | 4/1978 | Stoll | 318/783 |
| 4,182,980 | 1/1980 | Tholomé | 318/282 |
| 4,227,138 | 10/1980 | Espelage et al. | 318/807 |

FOREIGN PATENT DOCUMENTS

| | | |
|---|---|---|
| 969939 | 2/1948 | France . |
| 2314773 | 1/1977 | France . |

*Primary Examiner*—J. V. Truhe
*Assistant Examiner*—Eugene S. Indyk
*Attorney, Agent, or Firm*—Sandler & Greenblum

[57] ABSTRACT

A reciprocating drive system moves a body of defined inertia, such as a carriage supporting electrostatic spraying means, at full speed between two points at which the direction of movement is reversed. The drive system includes an electric motor with polyphase stator windings and a squirrel cage rotor. Transducers responsive to the arrival of the moving body at the aforementioned points produce output signals controlling a phase switching system which reverses the direction of rotation of the motor. Reversal of the motor torque reverses the direction of movement of the moving body within a given travel and within a given time interval to full speed in the opposite direction. A stator current limiter provides positive coupling in an operative condition and no coupling in an inoperative condition with the motor running at full speed. The motor is selected so that the inertia of its rotor closely matches that of the moving body. The current limiting means are arranged to be in the operative condition irrespective of the position of the moving body.

9 Claims, 8 Drawing Figures

RECIPROCATING DRIVE SYSTEM FOR A BODY SUCH AS A CARRIAGE SUPPORTING ELECTROSTATIC MEANS FOR SPRAYING A PULVERIZED MATERIAL, THE SYSTEM INCLUDING AN ASYNCHRONOUS SQUIRREL CAGE MOTOR

BACKGROUND OF THE INVENTION

The invention concerns a reciprocating drive system for moving a body of defined inertia, at full speed between two points at which the direction of movement is reversed, the drive system including an electric motor with polyphase stator windings and a squirrel cage rotor, a stator phase switching system, and transducers responsive to the arrival of the moving body at the aforementioned points at which the direction of movement is reversed and producing output signals controlling said phase switching system to reverse the direction of rotation of the motor rotor so that the reversal of the motor torque reverses the direction of movement of the moving body at full speed within a given travel and within a given time interval.

The problem for which this invention proposes a solution arises out of the operation of automatic installations for electrostatically spraying components with a pulverised product such as paint or enamel. The components to be covered are suspended from a transporter mechanism and are passed in front of electrostatic sprayers. Their dimensions transversely to the direction of movement are such that the obtaining of a uniform coating involves a reciprocating motion of the sprayers in the direction transverse to the direction of movement. To this end, the sprayers are mounted on a carriage which is moveable along guide means.

The solution to this problem involves driving the moving body at full speed, this speed being determined to obtain uniform covering of the component, between two points at which the direction of movement is reversed, the positions of these two points being adjustable to scan across the full transverse dimension of the component. The reversal of the direction of movement is occasioned by the arrival of the carriage at the points at which the movement is reversed. The reversal of movement must take place within a travel and within a time interval which are small relative to the travel and time interval with the moving body at full speed. This must be achieved without high rates of acceleration and deceleration such as to cause shock or other loading prejudical to the correct operation and service life of the equipment. It will be apparent that to obtain high rates of production the reversals of direction will occur frequently. In current equipment the direction of movement must be reversed several thousand times in each hour.

As most coating materials are inflammable, the equipment must not be capable of producing sparks or electrical arcs capable of igniting the product. An obvious further requirement is for the manufacturing and operating costs of the equipment to be held down to a reasonable value.

Generally speaking, the power required to drive a moving body such as a carriage supporting electrostatic spraying means at full speed is an order of magnitude lower than the power requirement during the reversal of the direction of movement, so that the dimensions of the drive system components are principally determined by the conditions applying during reversal of the direction of movement.

A hydraulic transmission system would be capable of meeting most of the stated requirements, but would be too costly for routine use, in particular because of the power required during reversal of direction and complexities inherent to any hydraulic transmission system.

DESCRIPTION OF THE PRIOR ART

My prior patent application Ser. No. 686 874 now U.S. Pat. No. 4,182,980 filed May 17, 1976 proposes a different approach to this problem. The carriage is driven along a slide by an asynchronous motor and chain transmission system. Recovery springs are located at the points at which the direction of movement is reversed. The power feed to the drive motor is cut off when the carriage arrives at one of the reversing points, where it comes into contact with the corresponding recovery spring. The kinetic energy of the moving parts (the carriage and the rotor of the motor) is stored up in the recovery spring as it brakes the moving components to a halt. Subsequent expansion of the spring starts these components moving in the opposite direction, the motor power feed phases being simultaneously switched over. With the spring fully expanded the motor is at substantially its full speed, providing the return carriage stroke at full speed without any power being absorbed by the motor during the reversal of direction. This arrangement does not provide for easy and fast adjustment of the positions of the points at which the direction of motion is reversed, since such adjustments involve operations on the slide frame to modify the positions. Nor is this arrangement suited for installations other than those for spraying large numbers of simple components of similar size.

The use of mechanical reversing means between the drive motor and carriage would involve the use of progressive action clutches to prevent shock and jamming. Such clutches are difficult to adjust, and would have to absorb twice the kinetic energy of the moving parts of the system at full speed on each change of direction. A reliable system of this type cannot be achieved at low cost.

In proposing a solution to this problem by the implementation of the present invention, it is envisaged that the moving body should travel on a slide and be driven by a rotary electric motor through a positive transmission system such as a chain and sprocket wheels. The reversal of the direction of movement of the moving body at the two points is to be obtained by electrically controlling the direction of rotation of the motor, so as to profit from the flexibility and remote control capabilities of electrical control systems. The result is that the system uses only inexpensive components which are readily available on the commercial market, and the construction of the moving body, the slide support frame and the transmission system coupling the motor to the moving body are simplified in the extreme.

It should be noted that, due to the positive transmission of power between the motor and the moving body, the energy absorbed on reversal of the direction of movement corresponds to the combined inertias of the moving body and the rotor of the motor. Essentially, the energy is dissipated in the motor. The efficiency of the reversal process decreases as the rotor inertia increases, whilst the power dissipation capability of the motor, which is substantially proportional to its nominal power, increases with the motor size and thus with the rotor inertia. Within a range of motors having approximately the same ratio of rotor inertia to nominal power, there is an optimum ratio between the inertia of the moving body and that of the rotor for optimizing efficiency. This requirement is similar to that whereby the source and load impedances of connected electrical circuits must be properly matched to provide optimum transfer of power.

From this point of view direct current motors, while readily controllable for reversing the direction of movement, have considerable rotor inertia for a given power rating, the inertia of this type of motor being very much higher than that of asynchronous squirrel cage motors. As a result, the matching of the motor inertia to that of the moving body is not possible, and most of the energy dissipated on reversal of the direction of movement is the kinetic energy of the rotor itself. Also, the rotor and the associated slip ring are unable to support repeated high overcurrents due to the reversal of the direction of movement. Finally, the slip ring produces sparks which means that in an explosive atmosphere the motors must be enclosed or otherwise protected, with mediocre cooling characteristics. Slip ring type alternating current motors have the same disadvantages as direct current motors, and generally offer lower levels of performance all round.

The only conclusion is that, in the current state of the art, only asynchronous motors with a squirrel cage rotor and polyphase stator can offer the torque and rotor inertia characteristic needed to provide a solution to the stated problem. Such motors are available at reasonable cost, in view of their relatively simple design and the fact that they are in widespread use. This will be confirmed by consulting electric motor manufacturers' catalogues, where the man skilled in the art will find all necessary information for selecting motors for applications involving frequent starting or reversal of direction.

Nevertheless, the use of asynchronous polyphase motors cannot provide a solution to the problems specific to the present invention, inter alia because such motors are unable to withstand reversal of the direction of rotation at the required frequency, the maximum frequency specified by manufacturers being lower than the required frequency.

SUMMARY OF THE INVENTION

To overcome the problem, the invention therefore proposes a reciprocating drive system for moving a body of defined inertia, such as for example a carriage supporting electrostatic means for spraying a pulverised coating material, at full speed between two points at which the direction of movement is reversed, said system including an electric motor with polyphase stator windings and a squirrel cage rotor, a stator phase switching system, transducers responsive to the arrival of the moving body at the aforementioned points at which the direction of movement is reversed and producing output signals controlling said phase switching system to reverse the direction of rotation of the motor rotor so that the reversal of the motor torque reverses the direction of movement of the moving body at full speed within a given travel and within a given time interval, and means for limiting the motor stator current, of the type which provides a positive coupling in an operative condition and no coupling in an inoperative condition when the motor is running at full speed, the drive systems being characterised in that the motor is selected so that its nominal power is substantially equal to the power sufficient to reverse the moving body and the rotor coupled thereto within said given time interval and in that said current limiting means are in the operative condition irrespective of the position of the moving body.

It is wellknown to fit a polyphase asynchronous motor with means for reducing the current in the stator windings, operative during starting so that the starting overcurrent is reduced to a value which is only slightly greater than the nominal current with the motor running at its rated speed. In spite of the reduction in the stator current, the starting torque is sufficient for the motor rotation speed to build up to a value at which the current limiting means is switched out of action to produce a slight overcurrent while the motor runs up to full speed. The man skilled in the art would never leave the current limiting means in operation once the start-up stage was completed, since the motor cannot achieve its nominal full speed with the current limiting means in operation and may overheat. Nevertheless, the applicant has carried out a thoroughgoing analysis of the operating conditions of the drive system, as already mentioned, and has come to the conclusion that the power demand to be satisfied by the motor during movement of the moving body at full speed is sufficiently low relative to the nominal power rating of motors selected on the basis of manufacturers' data to meet the inertia optimum ratio requirement, for the motor to achieve its nominal full speed with the current limiting means in the operative condition. Also, the direction of rotation of the motor can be reversed at the required frequency without abnormal temperature rise at the motor, corresponding to the absorption of an amount of energy approximately twice that required to start the motor.

Since the temperature rise in a motor is associated with the useful torque it provides, it is possible to adopt as a practical rule that the motor must be chosen so that its nominal torque at full speed, as indicated by the manufacturer's data, is equal to the torque required to reverse the direction of motion in a given time interval, due account being taken of the maximum acceleration and deceleration to which the moving body may be subjected. Also taken into account is the effect of the dead time in which the moving body decelerates and accelerates again on the process dependent upon the reciprocating motion of the moving body. It is then preferable for the current limiting means to limit the stator winding current so that the motor start torque is equal to the torque required to reverse the direction of movement of the moving body in the aforementioned given time interval. As a result, the motor will not overheat due to the frequent changes of direction and the process dependent on the reciprocating motion of the moving body will be executed correctly.

In an embodiment which is preferred for reasons of simplicity and economy, said current limiting means comprises a star/delta stator winding switch fixed in the star position.

Star/delta coupled starters are wellknown, providing a simple means of starting polyphase asynchronous motors with the windings receiving approximately 0.6 times the nominal voltage during starting and so drawing a reduced start current. It is worth remarking at this point that manufacturers frequently draw the attention of users to the inadvisability of operating motors at reduced voltage except during starting.

The current limiting means may comprise series-connected impedances in the stator winding power feed connections. The impedance may be provided by a resistance or inductance, or by two-state semiconductor devices and state-controlling means responsive to the current in the power feed conductors to control the period of current in each half-cycle. This type of current limiter is wellknown, but is always used in combination with switches which short-circuit the two-state semiconductor devices when the start sequence terminates, whereas in accordance with the present invention the two-state semiconductor devices remain in circuit when the moving body is travelling at full speed.

The drive system may incorporate means for controlling the speed of the motor including a polyphase inverter controlled by a variable pilot frequency, the motor being started without overcurrent conditions occurring by varying the pilot frequency from a start value to a full speed value, the motor slip, which is the difference between the supply frequency and the frequency corresponding to the rotation speed of the motor, remaining substantially constant throughout the start sequence. In the preferred embodiment, the motor speed control means is responsive to a signal from the transducers to execute a sequence of operations in which the pilot frequency is varied from the full speed value to the start value, the phase switching means is operated and the pilot frequency is then varied from the start value to the full speed value.

BRIEF DESCRIPTION OF THE DRAWINGS

Other objects and advantages of the invention will appear from the following description of an example of the invention, when considered in connection with the accompanying drawings, in which.

DESCRIPTION OF THE PREFERRED EMBODIMENT

Figure 1:
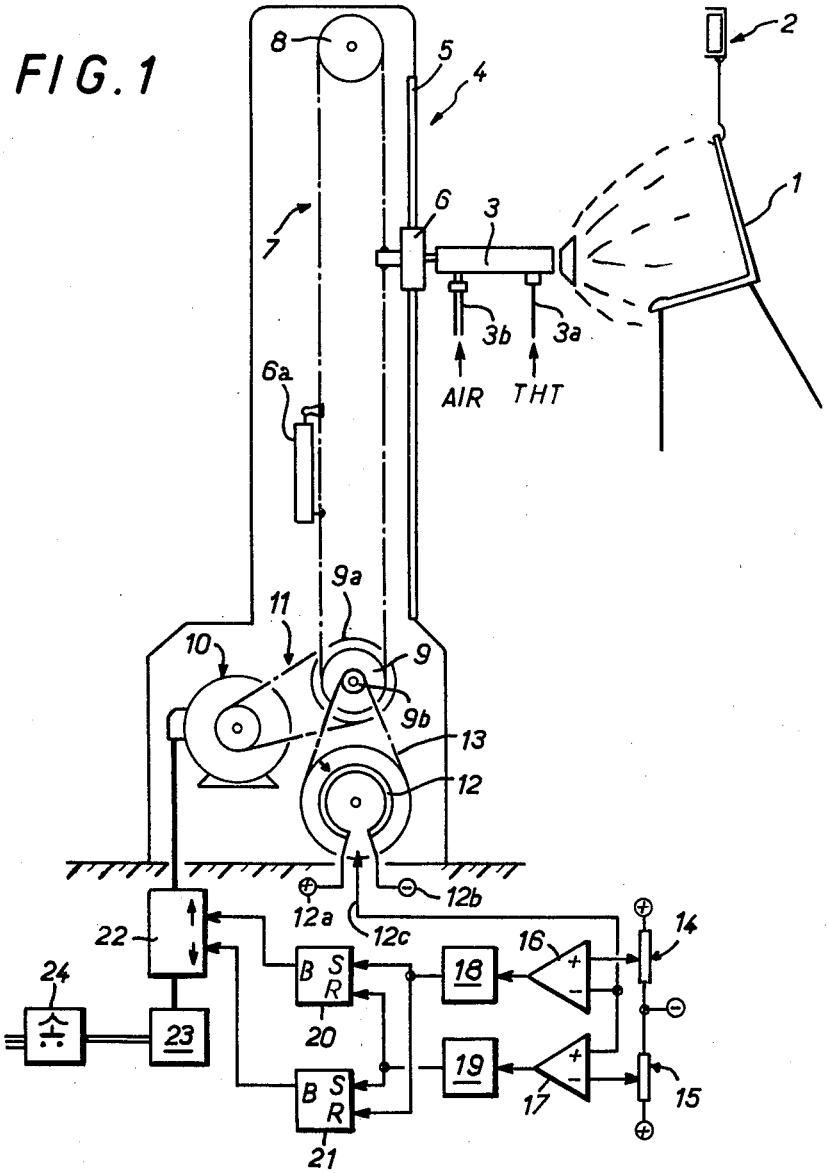
FIG. 1 is a schematic representation of an electrostatic spraying installation incorporating a drive system according to the invention.

In the embodiment as shown in FIG. 1, an installation for electrostatically spraying components 1 comprises, in the conventional manner, a conveyor 2 which moves the components 1 perpendicularly to the plane of the figure so as to pass them in front of a rotary head electrostatic sprayer 3 connected to a high voltage supply 3*a* and a compressed air supply 3*b* which drives a turbine in the rotary sprayer head.

To enable it to spray over the entire height of the component 1, the sprayer 3 is supported on a framework indicated generally at 4. The frame 4 has on its front surface, that directed towards the component 1, a vertical slide 5 on which moves a carriage 6 supporting the sprayer 3. The carriage 6 is attached to an endless chain 7 which passes over return sprocket wheels 8 and 9. The sprocket wheel 8 at the upper end is an idler wheel. The carriage 6 is balanced by a counterweight 6*a* attached to the rear run of the chain 7. The sprocket wheel 9 is keyed to a shaft to which is also keyed a sprocket wheel 9*a* driven by a motor 10 via a chain 11. Also keyed to this shaft is a sprocket wheel 9*b* which drives the rotor of a potentiometer 12 via a chain 13. The motor 10 is a three-phase asynchronous motor whose power feed connections are taken through a circuit-breaker 24, a start current limiting system 23 and a relay unit 22 for switching over two phases of the power feed connection to the rotor windings of the motor 10. The current limiting means 23 and relay unit 22 will be described in more detail below.

A constant voltage is applied between the fixed terminals 12*a* and 12*b* of the potentiometer 12. The voltage at the cursor terminal 12*c* relative to, for example, end terminal 12*b* is an accurate measure or "image" of the position of the cursor relative to the fixed potentiometer track. Since the potentiometer is driven by the chain 13 and sprocket wheel 9*b*, this voltage is also a measure of the position of the carriage 6 relative to the slide 5.

The cursor terminal 12*c* of the potentiometer 12 is connected to the negative input of a comparator 16 and to the positive input of a comparator 17. To the positive input of the comparator 16 is connected the cursor of a potentiometer 14 whose fixed terminals are connected to the positive and negative poles, respectively, of the voltage source connected to potentiometer 12. The cursor of a potentiometer 15 connected in the same way as potentiometer 14 is connected to the negative input of comparator 17. The potentiometers 14 and 15 are used to define points at the bottom and top of the carriage travel, respectively, at which the direction of movement is to be reversed. When the voltage on the cursor 12*c* is lower than the voltage set by potentiometer 14, the comparator 16 outputs a positive voltage. Likewise a positive voltage appears at the output of comparator 17 when the voltage on cursor 12*c* is higher than the voltage set by potentiometer 15. The outputs of comparators 16 and 17 are connected to respective decoupling circuits 18 and 19 which, in response to the appearance of a positive signal at their input, generate output signals controlling two flip-flops 20 and 21. The output of circuit 18 sets flip-flop 20 and resets flip-flop 21. The output of circuit 19 sets flip-flop 21 and resets flip-flop 20. Flip-flops 20 and 21 therefore change state simultaneously and in opposite directions. It will be understood that flip-flop 20 is set when the carriage 6 reaches the lower point at which the direction of movement is to be reversed, and that flip-flop 21 is set when the carriage 6 reaches the upper point at which the direction of movement is to be reversed. Flip-flops 20 and 21 are connected to the relay unit 22 in such a way that the setting of flip-flop 20 activates the stator of motor 10 so as to move the carriage 6 upwards, whereas the setting of flip-flop 21 causes the stator to move the carriage in the opposite direction.

The considerations on which the choice of a suitable motor is based will now be discussed with reference to a numerical example. The mass of the carriage 6, including the sprayer 3 and ancillary equipments is 20 kg. The mass of the moving body, including the counterweight 6*a*, is 40 kg. The full speed of the carriage is 1 m/s, and the mean length of slide over which the carriage passes is 1 m. As a compromise between the acceleration and deceleration loads on change of direction and non-uniformity of the deposit obtained during the change of direction, the mean acceleration is 10 $m/s^2$, the travel in which reversal is achieved being 0.05 m and the time interval in which reversal is achieved being 0.2 s. With these values, the direction of movement will be reversed 2400 times in each hour.

The mean power requirement on reversal of the direction of the moving body (i.e. required mechanical energy divided by reversal time interval) is approximately 200 W. For movement at constant speed, allowing for friction between the carriage 6 and the slide 5 and losses in the transmission, it is between 60 and 120 W. As a whole, reversal of the body alone requires about 300 W. As it is undesirable the power required to reverse the rotor alone be preponderant, the nominal power of the motor should be comprised between 300 and 600 W. Consultation of manufacturers' catalogues indicates that a three-phase asynchronous motor is available producing 550 W at 1400 RPM, with a rotor inertia of approximately $10^{-3}$ $m^2$ kg. Under the conditions applying to this example, this corresponds to a power requirement on reversing, for the motor alone, of 130 W. A higher rotor inertia could be tolerated, but the type of motor actually selected is that which best meets the imposed conditions in respect of motor dissipation and rotor inertia.

This being the case, the catalogue shows that the motor adopted can only withstand a much lower frequency of reversal of direction of movement than that required, but that the start torque of the motor at the nominal voltage, which is virtually equal to the torque required to reverse the direction of movement, is two or three times higher than that required to reverse the direction of movement of the moving body within the given travel and time interval, the stator current being five to six times the nominal current. Theoretical considerations corroborated by experimental tests have resulted in a stator current limit for reversal of direction of 1.3 to 1.5 times the nominal current, the start (or reversing) torque then being close to the nominal motor torque at full speed and at nominal power. This corresponds to a substantial extent to the start conditions for an asynchronous motor fitted with a starting system which reduces the stator current on starting. As is well-known, however, such starting means may not operate permanently, since the motor is not able to achieve its nominal torque under these conditions or its nominal speed. In the context of the present invention, however, the motor does not need to supply its nominal power when running at full speed, so that the start system may be maintained in operation continuously without causing problems.

Figure 2:
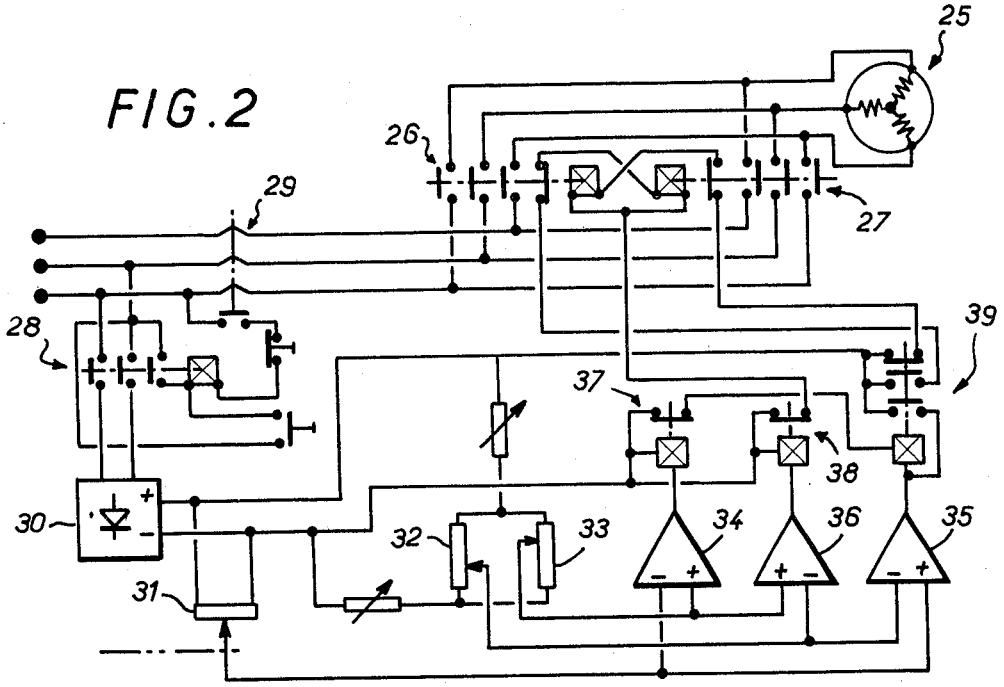
FIG. 2 is the electrical circuit diagram of the means for reversing the direction of movement.

The drive system as shown in FIG. 2 uses relay logic circuits. The asynchronous motor 25 is star-connected for reasons which will be explained later with reference to FIG. 3. The motor 25 is caused to rotate in one direction by the closure of relay 26 and in the other direction by the closure of relay 27, these two relays being electrically interlocked. The drive system is powered up by the closure of relay 28, which is controlled in the conventional manner by a set of pushbuttons and which connects the power feed to a rectifier 30. Overcurrent protection is provided conventionally by means of circuit-breaker 29 in the motor power feed connections and operable to trip the relay 28. The output of rectifier 30 feeds a potentiometer 31 whose cursor is attached to the transmission system for the moving body, as explained with reference to potentiometer 12 in FIG. 1. Potentiometers 32 and 33 correspond to potentiometers 14 and 15 in FIG. 1, and comparators 34 and 35 correspond to comparators 16 and 17 in this same FIG. 1. A comparator 36 has its inputs connected to the cursors of potentiometers 32 and 33 and controls a relay which can cut off the common return connections of the coils of relays 26 and 27. Thus if, for example, the set upper reversing point is lower than the set lower reversing point neither relay 26 nor relay 27 can operate. Comparator 36 controls a relay 39 which has a latching contact and which, in the operated position, controls relay 27 and, in the unoperated condition, controls relay 26. Comparator 34 controls relay 37, which operates relay 39. This arrangement provides the operation already described with reference to FIG. 1.

Figure 3:
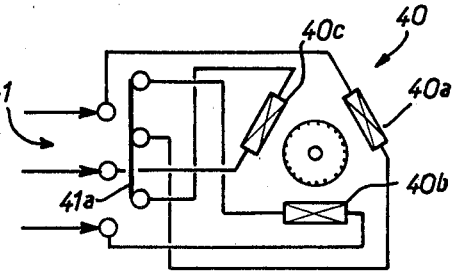
FIG. 3 is a schematic representation of a simple means of reducing the current drawn by an asynchronous motor.

As already mentioned, the motor 25 is star-connected. FIG. 3 shows the conventional star/delta connection of a motor 40. The opposite ends of each of the three phase windings 40*a*, 40*b* and 40*c* are independently connected to a terminal plate 41. In star connection the three winding output connections are connected together and the phase conductors are connected to the respective input connections. The voltage between two phase conductors is thus applied to two windings connected in series. In delta connection the output connection of one winding is connected to the input connection of the next winding, so that the voltage between two phase conductors is applied to one winding only. Because of the phase relationship between the conductors, each winding in star connection is subjected to approximately 0.6 times the voltage between the phase conductors. The motor 40 is designed for a voltage between phases of 220 V in delta connection or 380 V in star connection, but the links 41*a* define star connection while the voltage between phase conductors at the terminal plate 41 is 220 V. The motor 40 is therefore continuously connected to a reduced supply voltage, in the conventional transient condition of the star/delta switching sequence. If the motor were required to provide a continuous torque corresponding to its full speed power rating, it would be unable to attain full speed and would overheat. However, under the specific conditions of operation according to the present invention, the motor would overheat if the windings were delta-connected so as to supply the motor at the nominal voltage.

Figure 4:
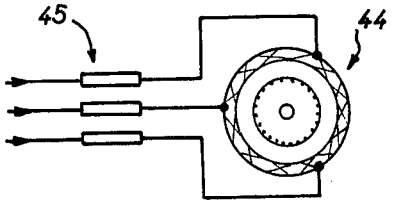
FIG. 4 is an alternative version of the current limiting means.

FIG. 4 shows another conventional arrangement for reducing the starting current of a polyphase asynchronous motor 44 with a squirrel cage rotor. The stator windings are fed via impedances 45 whose values are such that the start current is reduced to a value of 1.3 to 1.5 times the nominal current. In the conventional manner, these impedances may be constituted by resistors or cored inductors. Note that according to conventional teaching this stator impedance circuit should not be implemented continuously for the reasons already discussed in connection with the star/delta arrangement.

Figure 5:
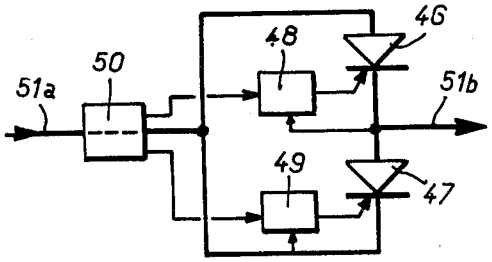
FIG. 5 is the circuit diagram of a stator winding series-connected impedance using semiconductor devices.

To avoid overheating of passive stator impedances, a circuit using semiconductor devices may be used, as shown in FIG. 5.

The actual impedance comprises two thyristors 46 and 47 connected in head-to-tail configuration between an input conductor 51*a* and an output conductor 51*b*. The respective firing control circuits 48 and 49 apply a control signal to the thyristor triggers at a variable time within the current half-wave for which the corresponding thyristor may be conducting. A current-sensing device 50 in conductor 51*a* operates the thyristor control circuits 48 and 49 to delay the firing of the thyristors when the current in the conductor 51*a* tends to increase. This starting impedance circuit does not form part of the invention proper, and will not be described in more detail here. Full details as to the configuration of the control circuit will be found in the literature.

Figure 6:
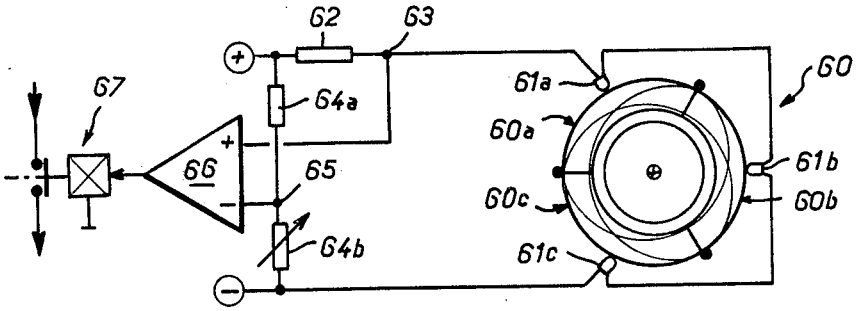
FIG. 6 is a diagram showing the locations of temperature sensors on the motor stator.

Since the operation of the system according to the invention involves frequent reversal of the direction of movement, and since the current drawn by the motor during reversal of movement, limited to prevent overheating, is substantially equal to the current drawn by the motor when stationary, conventional protective arrangements such as thermal circuit-breakers are of limited utility. If they are adjusted so as to operate if the motor is accidentally stopped for a few seconds, there is a risk of unwanted operation during normal use of the system, especially at high reversal rate. On the other hand, an adjustment such that operation is ruled out under normal conditions may result in accidental stoppages not tripping the protective system. It is therefore preferable to use a motor with temperature sensors on the stator windings, as shown in FIG. 6.

In this figure, the three stator windings 60*a*, 60*b* and 60*c* of the motor 60 are fitted with temperature sensors 61*a*, 61*b* and 61*c*, placed in contact with the respective windings at appropriate points. The sensors are resistors with positive temperature coefficients varying substantially exponentially with temperature. The sensors 61*a*, 61*b* and 61*c* are connected in series, and because the variation of resistance with temperature is relatively rapid, the overall resistance of the series-connected combination is principally determined by the temperature at the hottest sensor. The fitting of temperature sensors to motors is a conventional arrangement, offered as a standard feature by motor manufacturers together with electronic equipment connecting the sensors to conventional circuit-breakers protecting the motor. In the specific application of the present invention, however, it is preferable for this electronic circuitry to be integrated into the control logic. To this end, the series-connected sensors 61*a*, 61*b* and 61*c* are associated with an input end resistor 62 to form a voltage divider bridge connected between the positive and negative terminals of a direct current supply. The intermediate point 63 of this bridge is connected to the positive input of a comparator 66, the negative input of which is connected to the intermediate point 65 on a voltage divider bridge formed by the input end resistor 64*a* and the output end variable resistor 64*b*. A relay 67 controlled by the comparator 66 open-circuits one contact to shut down the device. In the arrangement shown in FIG. 2, this contact could be placed in series with the shut-off pushbutton of relay 28, or preferably in series with the contact of relay 38, which prevents the motor being powered up without shutting down the equipment as a whole.

Figure 7:
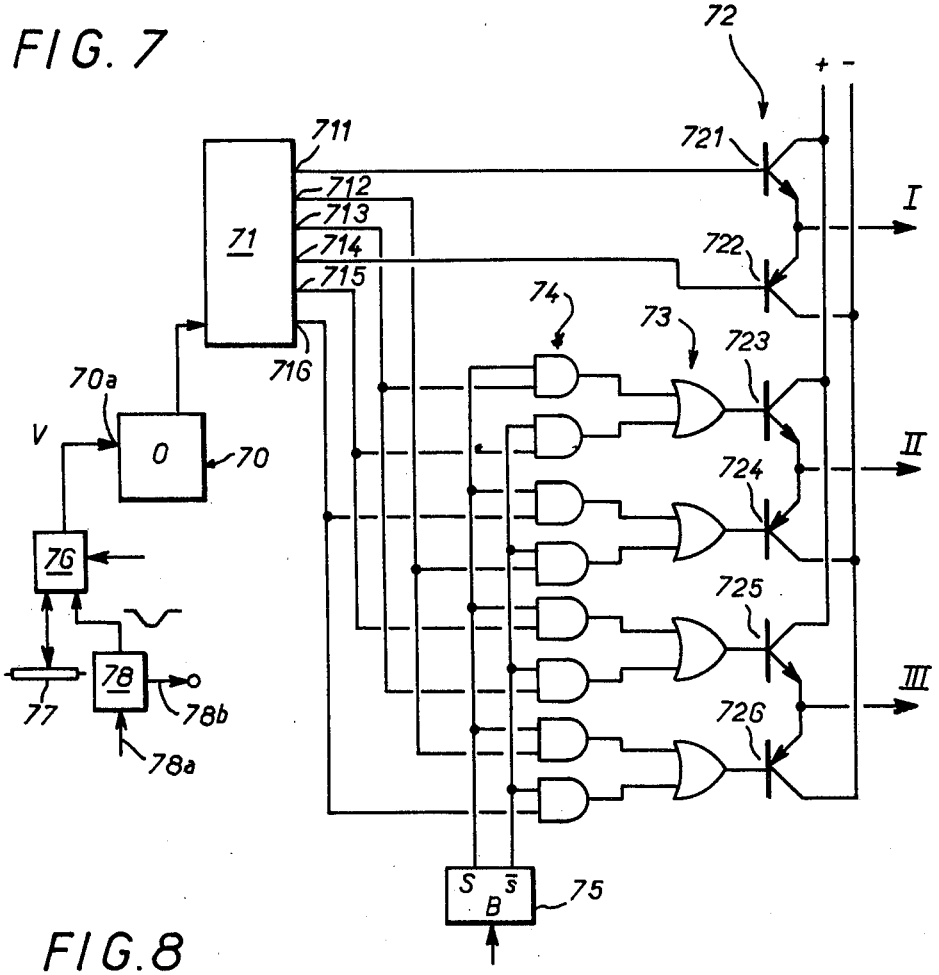
FIG. 7 is a block schematic of an inverter for controlling the speed of an asynchronous motor with a reversing facility.

When the speed of the reciprocatory movement of the carriage 6 (FIG. 1) must be variable, the preferred method of controlling the rotation speed of an asynchronous motor is to use a three-phase supply and an inverter controlled by a pilot frequency. FIG. 7 is a block schematic of such an inverter, integrated into the reciprocatory motion control logic.

A pilot oscillator 70 outputs pulses at a frequency which is a multiple of the sixth harmonic of the fundamental frequency of the three-phase voltage to be obtained, the output frequency of the oscillator 70 being proportional to the voltage at its input 70*a*. A scaler 71 provides at six outputs 711 to 716 streams of pulses at the pilot frequency. The stream at each output begins at the frequency of the sixth harmonic of the required fundamental frequency, being interrupted after three periods of the sixth harmonic. The pulse stream therefore corresponds to one half-wave of the fundamental frequency. The duration of the pulses in the stream is modulated so as to approximately reproduce the amplitude of a sinusoidal half-wave. It will be understood that the pulse streams on outputs 711 to 716 correspond, respectively, to the starts of the following half-waves: first phase positive, third phase negative, second phase positive, first phase negative, third phase positive and second phase negative. A modulator 72 comprises six transistors 721 to 726, the odd-numbered transistors being of the opposite polarity type to the even-numbered transistors. These transistors are connected between the positive and negative poles of a power source derived from the three-phase alternating current mains supply. They are connected to receive the pulse streams from outputs 711 to 716, the connection being such that the currents in output conductors I, II and III are substantially sinusoidal three-phase currents. If it were not necessary to switch over two phases to reverse the direction of rotation of the motor feed conductors I, II and III, the outputs 711 to 716 would be directly connected to the bases of the respective transistors 721, 726, 723, 722, 725 and 724, or transistors 721, 724, 725, 722, 723 and 726. A set of eight AND gates 74 is controlled by the positive and negative outputs of a flip-flop 75. According to the state of the flip-flop 75, one or other of the aforementioned combinations is selected. A set of four OR gates 73 decouples the outputs of the gates 74 associated with the same one of transistors 723 to 726. The two states of the flip-flop 75 correspond to the two directions of rotation of the motor. The transistors operate in switching mode, the current passing through the conductive transistors being smoothed by the inductance of the motor windings. As the motor current varies under steady state conditions in inverse proportion to frequency at a given voltage, the duration of the individual pulses in the pulse stream is maintained so that the rms value of the voltage across the motor terminals varies in the same sense as the frequency. This arrangement will be wellknown to those skilled in the art.

To obtain reversal of direction while limiting the current in the motor stator windings, the known technique of starting the motor by increasing the control frequency from a start value to a full speed value is used. The increase in the frequency corresponds to substantially constant slip. The "slip" is the difference in frequency between the rotating magnetic field generated by the stator windings and the frequency corresponding to the rotation speed of the motor. The slip frequency is the frequency of the current induced in the bars of the rotor, the current varying with the frequency when the cage inductance is low relative to its resistance at the slip frequency. The torque is a direct function of the current in the cage bars, so that to a first approximation the torque is constant if the slip is constant, so that starting up at constant slip is equivalent to starting up at reduced current.

Returning to FIG. 7, the pilot frequency control voltage applied to input 70*a* of the pilot oscillator 70 is obtained via a switch 76 from a potentiometer 77 for setting the full speed or from a control element, in this instance a voltage control element 78 which is responsive to a control signal on its input 78*a* to apply to the switch 76 a ramp voltage of decreasing amplitude corresponding the progressive change from the full speed frequency to the start frequency, followed by a ramp voltage of increasing amplitude corresponding to the progressive change from the start frequency to the full speed frequency. On transition from the decreasing amplitude ramp to the increasing amplitude ramp, the voltage control element output 78*b* carries a signal which operates the flip-flop 75.

Figure 8:
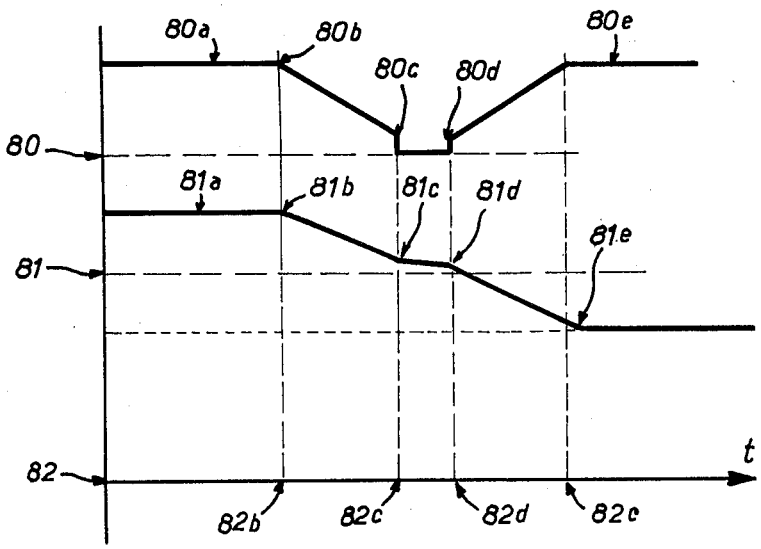
FIG. 8 is a waveform diagram corresponding to FIG. 7.

The sequence of operations will be better understood with reference to FIG. 8, in which curve 80 corresponds to the variation in the pilot frequency control voltage during reversal of the direction of movement and curve 81 indicates the resulting motor speed, curve 82 representing the time scale.

During travel at full speed, the pilot frequency control voltage is at the value 80*a* set by potentiometer 77 (FIG. 7). The motor rotates at speed 81*a*. When the moving body arrives at one of the points at which the direction of movement is reversed at time 82*b*, the pilot frequency control voltage decreases linearly from the value 80*b* (at time 82*b*) to the value 80*c* (time 82*c*). The voltage then drops to zero until time 82*d*. at which it goes to the value 80*d* which is substantially equal to the value 80*c*. From time 82*d* to time 82*e* the pilot frequency control voltage is a ramp function of increasing amplitude, terminating at the value 80*e* which is equal to the value 80*a*. The output frequency of the pilot oscillator 70 (FIG. 7) faithfully follows the pilot frequency control voltage 80.

At time 82*b* the motor speed begins to decrease, the slip decreasing and then reversing by virtue of the inertia of the moving components which, instead of being driven, are now being braked. The speed transition at 81*b* is rounded so as to join on to a straight line segment of the curve extending to value 81*c* at time 82*c*. At this time or somewhere between 82*b* and 82*c* the pilot oscillator is shut down but the motor continues to run (at the so-called start speed), decelerating slightly under the influence of mechanical friction, until time 82*d* at which the start frequency (80*d*) reappears. Between times 82*c* and 82*d* the motor supply phases are switched over. At time 82*d* the motor is running at reduced speed and is subjected to a drive torque in the opposite direction to that in which it is still rotating. The slip is therefore higher for a brief interval than its mean value during the change of direction, so that the speed curve 81 is rounded at 81*d*. The slip stabilises and the motor accelerates to time 82*e*, beyond which full speed is maintained after a short transition interval 81*e*.

It has been found that at very low values of the pilot frequency the motor tends to stop. It is known that applying a direct current to the stator of an asynchronous motor is an effective method for braking the motor, and it is probable that the half-waves from the inverter act in the same way as a direct current. It is for this reason that the pilot oscillator is shut down between times 82*c* and 82*d* and possibly from a time between 82*b* and 82*c*.

It will be apparent that although the present invention has been described with reference to an embodiment relating to electrostatic spraying the invention is in no way limited to any such application, but is applicable to all applications in which it is necessary to drive a moving body with a reciprocating motion with a high frequency of reversal of the direction of movement.

I claim:

1. A reciprocating drive system for moving a body of defined inertia, such as for example a carriage supporting electrostatic means for spraying a pulverized coating material, at full speed between two points at which the direction of movement is reversed, said drive system including:

an electric motor with polyphase stator windings and a squirrel cage rotor;

a stator phase switching system;

transducers responsive to the arrival of the moving body at the aforementioned points at which the direction of movement is reversed and producing output signals controlling said phase switching system to reverse the direction of rotation of the motor rotor so that the reversal of the motor torque reverses the direction of movement of the moving body at full speed within a given travel and within a given time interval; and current limiting means of the type which provides a positive coupling in an operative condition for limiting stator current during motor startup, and no coupling in an inoperative condition when the motor is running at full speed; the drive system being characterised in that the motor is selected so that its nominal power is substantially equal to the power sufficient to reverse the moving body and the rotor coupled thereto, within said given time interval, and in that said current limiting means remains in the operative condition irrespective of the position of the moving body.

2. A drive system according to claim 1, characterised in that the current limiting means are adapted to limit the stator current so that the motor start torque is equal to the torque required to reverse the direction of movement of the moving body.

3. A drive system according to claim 1 or claim 2, characterised in that said current limiting means comprises a star/delta stator winding switch fixed in the star position.

4. A drive system according to claim 1 or claim 2, characterised in that said current limiting means comprises series-connected impedances in the stator winding power feed connections.

5. A drive system according to claim 4, characterised in that said impedances comprise two-state semiconductor devices and state-controlling means responsive to the current in the power feed conductors to control the period of current flow in each half-cycle.

6. A drive system according to claim 1 or claim 2, comprising means for controlling the speed of the motor including a polyphase inverter, a generator producing a variable pilot frequency controlling the inverter and a control element connected to vary the pilot frequency between a start value and a full speed value, characterised in that the control element is responsive to a signal from either transducer to execute a sequence of operations in which the pilot frequency is varied from the full speed value to the start value, the phase switching means is operated and the pilot frequency is varied from the start value to the full speed value.

7. A drive system according to claim 6, characterised in that the pilot generator is shut down before or when the pilot frequency reaches the start value.

8. A drive system according to claim 1 or claim 2, characterised in that said transducers comprise a "position" voltage source whose output voltage provides a measure of the position of the moving body, two variable reference voltage sources, each reference voltage corresponding to a respective end position of the moving body, two comparators each connected to one reference voltage source and to the position voltage source, and logic means interposed between the comparators and the phase switching means.

9. A drive system according to claim 8, in which the motor incorporates stator winding temperature sensors, characterised in that said sensors are connected to said logic means so as to cut off the stator power feed in response to an excess temperature indication from said sensors.

* * * * *

UNITED STATES PATENT AND TRADEMARK OFFICE

CERTIFICATE OF CORRECTION

PATENT NO. : 4,335,342

DATED : June 15, 1982

INVENTOR(S) : Roger THOLOME

It is certified that error appears in the above-identified patent and that said Letters Patent is hereby corrected as shown below:

On the title page, first column, the location of the assignee should be --Courbevoie, Hauts-de-Seine, France--.

Signed and Sealed this

*Sixteenth* Day of *November 1982*

[SEAL]

*Attest:*

GERALD J. MOSSINGHOFF

*Attesting Officer*

*Commissioner of Patents and Trademarks*